US011530594B2

(12) United States Patent
Quero et al.

(10) Patent No.: US 11,530,594 B2
(45) Date of Patent: Dec. 20, 2022

(54) WELLBORE ISOLATION DEVICE

(71) Applicant: HALLIBURTON ENERGY SERVICES, INC., Houston, TX (US)

(72) Inventors: Philippe Quero, Houston, TX (US); Eric Bivens, Littleton, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 281 days.

(21) Appl. No.: 16/651,812

(22) PCT Filed: May 17, 2019

(86) PCT No.: PCT/US2019/032957
§ 371 (c)(1),
(2) Date: Mar. 27, 2020

(87) PCT Pub. No.: WO2020/236141
PCT Pub. Date: Nov. 26, 2020

(65) Prior Publication Data

US 2021/0404284 A1 Dec. 30, 2021

(51) Int. Cl.
*E21B 33/12* (2006.01)
*E21B 33/124* (2006.01)
*E21B 33/128* (2006.01)

(52) U.S. Cl.
CPC ..... *E21B 33/124* (2013.01); *E21B 33/128* (2013.01)

(58) Field of Classification Search
CPC ..... E21B 33/1243; E21B 33/1275; E21B 33/1272; E21B 33/127; E21B 33/128; E21B 33/124; E21B 2200/06
See application file for complete search history.

(56) References Cited

U.S. PATENT DOCUMENTS 3,439,740 A * 4/1969 Conover ..... E21B 33/1246 166/290
3,575,237 A * 4/1971 Malone ..... E21B 33/1272 166/187

(Continued)

FOREIGN PATENT DOCUMENTS

EP 2643547 A1 10/2013
WO 2012068672 A1 5/2012
WO 2018211284 A1 11/2018

OTHER PUBLICATIONS

International Search Report and Written Opinion for International application No. PCT/US2019/032957, dated Feb. 14, 2020, 9 pages.

*Primary Examiner* — Christopher J Sebesta
(74) *Attorney, Agent, or Firm* — Novak Druce Carroll LLP

(57) ABSTRACT

A wellbore isolation assembly has an outer housing having an inner bore having a treatment port formed therein, and a floating inner mandrel disposed within the inner bore. The floating inner mandrel can have an inner bore formed therethrough with a fluid port formed therein. One or more fluid chambers, disposed in an annulus formed between the outer housing and the floating inner mandrel, having a working fluid operably disposed therein and one or more inflatable elements operable to receive the working fluid therein. A plunger disposed in the annulus and coupled with the floating inner mandrel and operable to urge the working fluid from the one or more fluid chambers to the one or more inflatable elements. The floating inner mandrel operable to transition between a first position and a second position and the treatment port and the fluid port substantially aligned in the second position.

20 Claims, 4 Drawing Sheets

(56) References Cited

U.S. PATENT DOCUMENTS

| | | | | |
|---|---|---|---|---|
| 5,058,673 | A | 10/1991 | Muller et al. | |
| 5,383,520 | A | 1/1995 | Tucker et al. | |
| 5,782,306 | A | 7/1998 | Serafin | |
| 5,832,998 | A | 11/1998 | Decker et al. | |
| 7,191,844 | B2 | 3/2007 | Kenison et al. | |
| 2005/0011678 | A1* | 1/2005 | Akinlade | E21B 33/1243 166/279 |
| 2012/0261127 | A1* | 10/2012 | Zhou | E21B 21/103 166/118 |
| 2015/0027724 | A1 | 1/2015 | Symms | |
| 2015/0152711 | A1* | 6/2015 | Foong | E21B 34/102 166/373 |
| 2015/0376976 | A1 | 12/2015 | Helms et al. | |
| 2016/0084079 | A1 | 3/2016 | Zhou | |
| 2017/0145784 | A1* | 5/2017 | Zhou | E21B 33/1285 |

* cited by examiner

WELLBORE ISOLATION DEVICE

CROSS-REFERENCE TO RELATED APPLICATIONS

This application is a national stage entry of PCT/US2019/032957 filed May 17, 2019, said application is expressly incorporated herein in its entirety.

FIELD

The present application is directed to an isolation device. More specifically, this application is directed to a sealed inflatable isolation device.

BACKGROUND

Wellbore isolation devices can be implemented in downhole environments to isolate one or more zones during treatment within a wellbore. Wellbore isolation devices engage a portion of the wellbore to prevent fluid flow uphole and/or downhole from the isolated zone, however these sealing elements can be exposed to damage while the tool is run in hole to the appropriate location. Further, wellbore isolation devices can be limited by the inner diameter of the wellbore and/or downhole tool strings uphole from the target interval to be isolated.

BRIEF DESCRIPTION OF THE DRAWINGS

Embodiments of the present application are described, by way of example only, with reference to the attached Figures, wherein.

DETAILED DESCRIPTION

Figure 1:
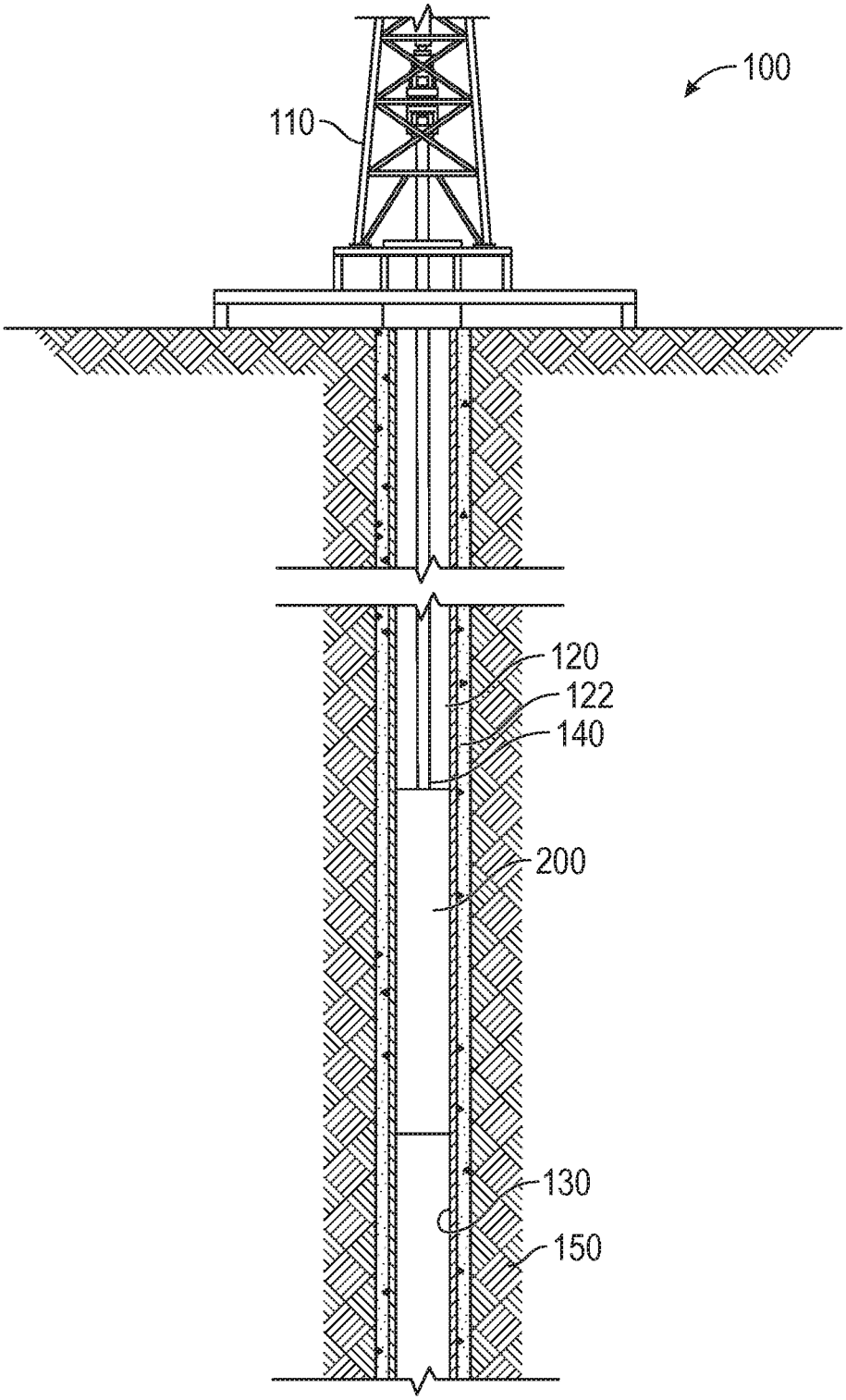
FIG. 1 is a diagrammatic view illustrating an exemplary environment for a wellbore isolation assembly, according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

Several definitions that apply throughout this disclosure will now be presented. The terms "comprising," "including" and "having" are used interchangeably in this disclosure. The terms "comprising," "including" and "having" mean to include, but are not necessarily limited to, the things so described.

The present disclosure provides a system for repetitive well bore isolation within a downhole environment. The wellbore isolation system can include a longitudinally extending outer housing having a longitudinally extending floating mandrel disposed therein. The outer housing can have an inner bore formed longitudinally therethrough in which the floating mandrel is received, while the floating mandrel can similarly have an inner bore formed longitudinally therethrough. The outer housing and the floating mandrel can each have a fluid port at a distal end of the longitudinally extending inner bores, thereby allowing fluid flow through the inner bore of the floating mandrel and into a wellbore and/or adjacent elements of a tubing string.

One or more fluid chambers can be formed within the annulus between the outer housing and the floating mandrel. The outer housing can have an inflatable element operable to receive at least a portion of a fluid from at least one of the one or more fluid chambers when the floating mandrel is moved from a first position to a second position within the outer housing. The floating mandrel can transition from the first portion to the second portion upon application of a predetermined actuation pressure. The predetermined actuation pressure can be a predetermined fluid pressure within the inner bore of the floating mandrel. In at least one instance, the predetermined fluid pressure can be a fluid pressure achieved by a fluid flow through the inner bore of the floating mandrel and fluid port. In other instances, the predetermined fluid pressure can be pressure built within the inner bore of the floating mandrel. The determined actuation pressure can also be formed by a linear actuator, or any other device operable to translate the inner mandrel from the first position to the second position. In some instances, the floating mandrel can remain in the second position during the application of the actuation pressure. In other instances, the floating mandrel can remain in the second position pending a second actuation pressure (or event).

The wellbore isolation system can also include one or more biasing elements operable to transition the floating mandrel from the second position to the first position upon release of the predetermined actuation pressure. Release of the predetermined pressure and/or assisted by the one or more biasing elements can allow the fluid to return into the annulus, thus withdrawing/retracting the inflatable element.

The outer housing can have a treatment port formed through a sidewall thereof and the floating inner mandrel can have a corresponding treatment port formed in a sidewall thereof. The treatment port of the outer housing and the corresponding treatment port of the can be substantially aligned when the floating mandrel is in the second position, and substantially misaligned when the floating mandrel is in the first position. The substantially aligned treatment port and corresponding treatment port can fluidicly couple the inner bore of the floating mandrel with an exterior of the outer housing. The fluidic coupling can allow a specific fluid to be pumped through the inner bore of the inner mandrel and out of the wellbore isolation system at a predetermined location (e.g. the treatment port).

In at least one instance, the wellbore isolation system can be operably disposed within a wellbore environment. The floating mandrel transitioning from the first position to the second position, thereby moving fluid into the one or more inflatable elements and isolating at least a portion of the wellbore. The substantially aligned treatment port and corresponding treatment port can allow a desired fluid to be pumped downhole through the inner bore of the floating mandrel and into the formation for the desired treatment.

A wellbore isolation assembly can be deployed in an exemplary wellbore system 100 shown, for example, in FIG. 1. A system 100 for wellbore isolation can include a rig 110 extending over and around a wellbore 120. The wellbore 120 is drilled within an earth formation 150 and has a casing 130 lining the wellbore 120, the casing 130 may be held into place by cement 122. A wellbore isolation assembly 200 can include a plurality of discrete components. The wellbore isolation assembly 200 can be moved down the wellbore 120 via a conveyance 140 to a desired location. A conveyance can be, for example, tubing-conveyed, coiled tubing, joint tubing, or other tubulars, wireline, slickline, work string, or any other suitable means for conveying tools into a wellbore. Once the wellbore isolation assembly 200 reaches the desired location an actuation force can be implemented to transition the wellbore isolation assembly 200 from a first position to a second position, thereby securing the wellbore isolation assembly 200 into place.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Figure 2:
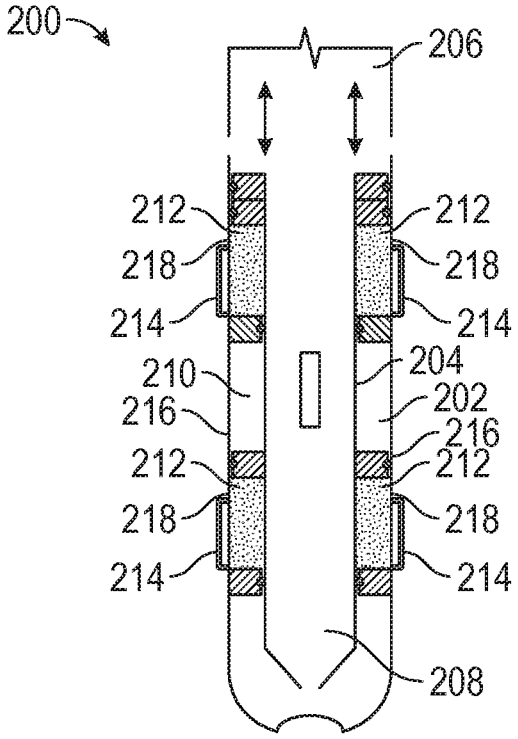
FIG. 2 is a diagrammatic view of a wellbore isolation assembly, according to the present disclosure.

FIG. 2 illustrates a diagrammatic view of a wellbore isolation system. The wellbore isolation system 200 can have an outer housing 202 and a floating inner mandrel 204 disposed therein. The outer housing 202 can be substantially longitudinally extending and the floating mandrel 204 can be substantially longitudinally extending and receivable therein. The outer housing 202 can have an inner bore 206 formed longitudinally therethrough in which the floating mandrel 204 is received, while the floating mandrel 204 can similarly have an inner bore 208 formed longitudinally therethrough.

The outer housing 202 and inner mandrel 204 can collectively define an annulus 210 formed therebetween. The annulus 210 can define one or more fluid chambers 212 in fluidic communication with one or more inflatable elements 214. The one or more inflatable elements 214 can be operable to receive fluid from the one or more fluid chambers 212, thereby expanding and extending beyond an exterior surface 216 of the outer housing 202. In at least one instance, the one or more inflatable elements 214 are operable to engage with and seat against a wellbore, thereby isolating at least a portion of the wellbore and/or open formation.

Figure 5:
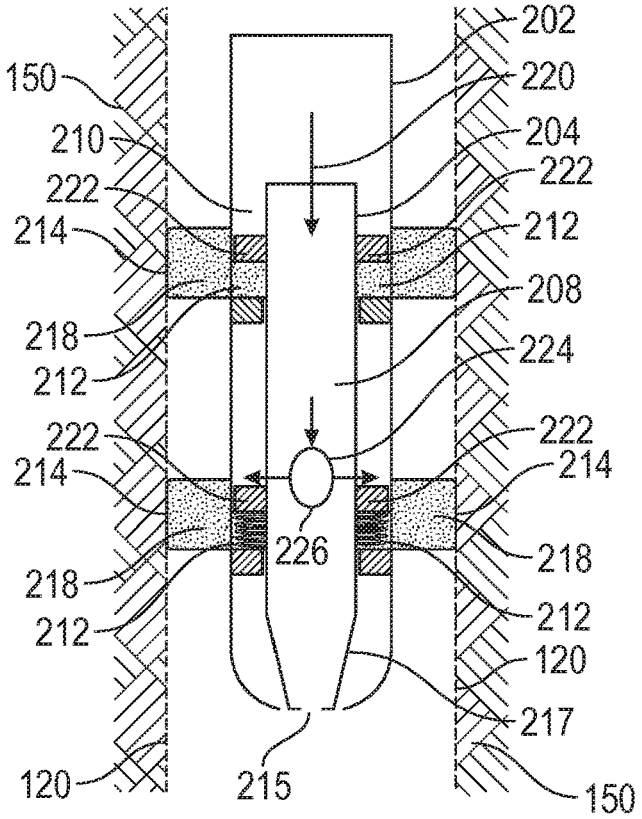
FIG. 5 is a diagrammatic view of a wellbore isolation assembly in a second position.

The floating inner mandrel 204 can be transitionable within the outer housing 202 between a first position, as shown in FIG. 2, and a second position, shown more clearly in FIG. 5. In the first position, the one or more inflatable elements 214 can be substantially deflated, thus allowing the wellbore isolation system 200 to be easily moved within the subterranean wellbore environment. In the second position, the one or more inflatable elements 214 can be substantially inflated, wherein the one or more inflatable elements 214 can be engaged with and isolating at least a portion of the wellbore.

The one or more fluid chambers 212 can be operable to receive a working fluid 218 therein. As the floating mandrel 204 is transitioned from the first position to the second position, the working fluid 218 can be transferred from the one or more fluid chambers 212 to the one or more inflatable elements 214. The one or more fluid chambers 212 and the one or more inflatable elements 214 can be fluidicly coupled one to the other and substantially hermetically sealed from the outside environment. As the floating mandrel 204 is transitioned from the second position to the first position, the working fluid 218 can be moved from the one or more inflatable elements 214 to the one or more fluid chambers 212.

The one or more inflatable elements 214 can be sized, shaped, and/or arranged for the particular environment and desired sealing. The wellbore isolation system 200 can include any number of inflatable elements 214 including, but not limited to, one, two, three, four or more inflatable elements.

The inner floating mandrel 204 can have an aperture 215 at a distal end 217 of the inner bore 208. The aperture can allow fluid flow through the inner bore 208 and/or the wellbore isolation device. The aperture 215 can be sized and/or shaped to allow a pressure differential to increase at a predetermined float rate, thereby transitioning the wellbore isolation device from the first position to the second position.

The aperture 215 can similarly be sized and/or shaped to receive a ball, dart, or other seating device operable to block fluid flow through the inner bore 208, thereby allowing a fluid flow into the inner bore 208 to generate a pressure build up and transition the wellbore isolation device 200 from the first position to the second position.

Figure 3:
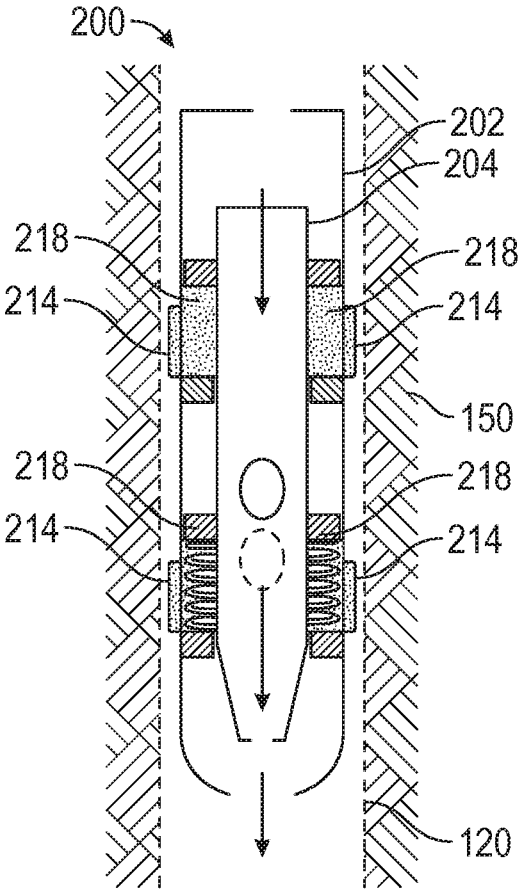
FIG. 3 is a diagrammatic view of a wellbore isolation assembly experiencing a low flow rate therethrough, according to the present disclosure.

FIG. 3 illustrates a diagrammatic view of a wellbore isolation system receiving a low flow rate therethrough. The floating inner mandrel 204 can have receive a fluid flow therein operable to pass therethrough and downhole without transitioning from the first position to the second position. The aperture 215 formed at the distal end 217 of the inner mandrel 204 can allow fluid flow therethrough at a flow rate less than the predetermined flow rate operable act as an actuation force 220. The aperture 215 can allow lower fluid flow rates to pass through the wellbore isolation assembly 200. The low fluid flow rates can enable forward circulation and/or treatments to be performed through the wellbore isolation assembly 200 when not isolating and/or targeting a particular zone of the wellbore.

The low fluid flow rates can allow the wellbore isolation assembly 200 to be implemented and/or utilized during well operations including isolation treatments and/or standard circulation operations. The wellbore isolation assembly 200 can be cyclically implemented during such operation without the need to remove and/or reinstall the assembly 200 into the wellbore environment.

The floating inner mandrel 204 can resist transitioning from the first position to the second position until the actuation force 220 is applied. In at least one instance, the actuation force 220 can be a predetermined flow rate through the inner bore 208 of the floating inner mandrel 204. In other instances, the actuation force 220 can be a ball and/or dart dropped to seal the aperture 215, thereby allowing fluid flow into the inner bore 208 to generate the actuation force 220.

Figure 4:
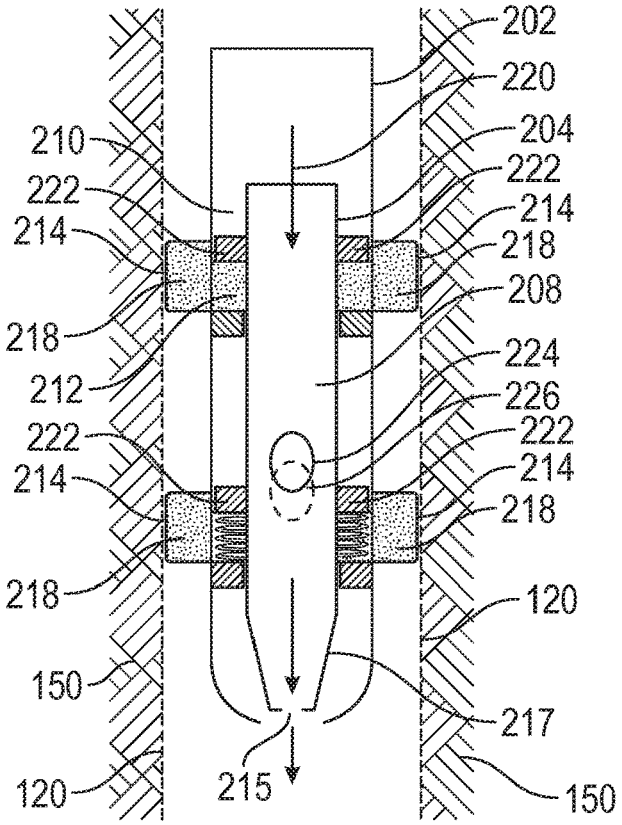
FIG. 4 is a diagrammatic view of a wellbore isolation assembly further transitioning from a first position to a second position, according to the present disclosure.

FIG. 4 illustrates a diagrammatic view of a wellbore isolation system transitioning from a first position to a second position. An actuation force 220 can be generated to transition the floating inner mandrel 204 downhole relative to the outer housing 202. In at least one instance, the actuation force 220 can be generated by a fluid flow into and/or through the inner boar 208 of the inner floating mandrel 204, thereby creating a pressure build up and urging the floating inner mandrel 204 toward the second position. The actuation force 220 can be any force operable to transition the floating inner mandrel 204 within the outer housing 202 from the first position to the second position. The actuation force 220 can be generated by fluid flow, a linear actuator, a pressure increase, a ball drop, dart, and/or any combination thereof.

As the floating inner mandrel 204 transitions within, the working fluid 218 can be transferred from the one or more fluid chambers 212 to the one or more inflatable elements 214. The working fluid can be urged from the one or more fluid chambers 212 by a plunger 222 within the annulus and coupled within the inner floating mandrel 204. The plunger 222 can move in concert with the floating inner mandrel 204, thereby generating a pressure increase by reducing the volumetric size of the one or more fluid chambers 212. Each of the one or more fluid chambers 212 can have an individual plunger 222 associated therewith and reducing the volumetric size of the associate fluid chamber 212.

The working fluid 218 can be transferred from the one or more inflatable elements 214 to the one or more fluid chambers 212 by a pressure differential created by increasing the volumetric size of the one or more fluid chambers 212. In at least one instance, the working fluid 218 can be an incompressible fluid. The one or more inflatable elements can be a operable to extend beyond the outer housing 202 as the working fluid 218 is received therein.

The floating inner mandrel 204 can move further downhole due the actuation force 220, thereby continuing displacement of the working fluid 218 into the one or more inflatable elements 214. The one or more inflatable elements 214 can be operable to expand in a predetermined shape while similarly being flexible enough to substantially take a corresponding shape of an engagement surface (e.g. wellbore or formation).

The floating inner mandrel 204 transitioning from the first position to the second position relative to the outer housing 202 can draw the fluid port 224 and the treatment port 226 closer to substantial alignment. As the fluid port 224 and the treatment port 226 begin alignment, a treatment fluid can pass from the inner bore 208 through the fluid port 224 and treatment port 226, thereby interacting with at least a portion of the wellbore and/or subterranean formation.

While FIG. 4 illustrates a working fluid 218 generating an actuation force 220 by pressure differential fluid flow through the inner bore 208 and the aperture 215, it is within the scope of this disclosure to implement a ball, dart, and/or other seating device to restrict fluid flow through the aperture 215, thereby generating the actuation force 220.

FIG. 5 illustrates a diagrammatic view of a wellbore isolation system in a second position. The fluid port 224 and the treatment port 226 can substantially align, thereby allowing a treatment fluid to be pumped through the wellbore isolation device 200 and into a desired portion of the wellbore and/or subterranean formation.

The wellbore isolation system 200 in the second position can have the one or more inflatable elements 214 substantially filled with the working fluid 218 and engaged with the wellbore. The one or more inflatable elements 214 having the working fluid 218 received therein can circumferentially extend about the exterior 216 of the outer housing 202. The one or more inflatable elements circumferentially extend around the outer housing, thus forming an isolation zone 238.

In at least one instance, as illustrated in FIGS. 3-5, the treatment port 226 on the outer housing 202 is disposed between two longitudinally displaced inflatable elements 214. The two longitudinally displaced inflatable elements 214 can produce the isolation zone 228 therebetween. The treatment fluid can be operable to exit the treatment port 226 in the isolation zone 238. In other instances, the wellbore isolation device 200 can have one inflatable element 214 operable to produce an isolation zone above and/or below the treatment port 226.

The inner floating mandrel 204 can transition from the first position to the second position by flowing a treatment fluid through the inner bore 208 of the inner floating mandrel, thereby creating a pressure differential to urge the inner floating mandrel 204 to the second position. In at least one instance, the treatment fluid can be a series of fluids for use within the wellbore isolation system, such as an inert fluid, such as water, use to transition the wellbore isolation system 200 from the first position to the second position followed by one or more treatment fluids to pass through the treatment port 226 upon alignment of the treatment port 226 and the fluid port 224 and into the adjacent subterranean formation.

In at least one instance, the fluid flow through the inner bore 208 can be maintained at a predetermined flow rate, thus maintaining a predetermined pressure differential and thus actuation force 220, thereby keeping the wellbore isolation device 200 in the second position. Upon reduction of the predetermined flow rate, the wellbore isolation device can urge back to the first position.

The wellbore isolation device 200 can include a J-slot or other engagement mechanism operable to maintain the second position until a subsequent actuation event. In at least one instance, an over pressure event exceeding the desired treatment pressure can be implemented to release the J-slot, thereby allowing the wellbore isolation device to transition from the second position to the first position.

Figure 6:
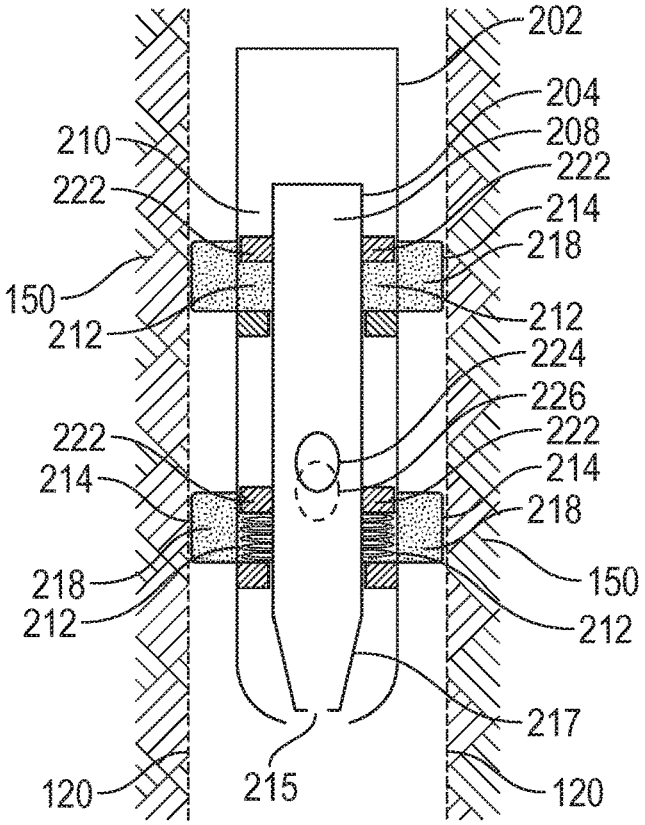
FIG. 6 is a diagrammatic view of a wellbore isolation assembly in transition from a second position to a first position.

FIG. 6 illustrates a diagrammatic view of a wellbore isolation system further transitioning from a second position to a first position. The wellbore isolation device 200 can transition from the second position to the first position, thereby releasing engagement with the wellbore and allowing a downhole tool string to move within the wellbore and thus treat other and/or adjacent portions of the wellbore.

The wellbore isolation device 200 can include a biasing element 230 operable to assist in transitioning from the second position to the first position. The biasing element 230 can be a spring, linear actuator, or any other element biasing the floating inner mandrel 204 toward the first position. The floating inner mandrel 204 moving toward the first position can generate a pressure differential within the one or more fluid chambers 212, thereby drawing the working fluid 218 into the one or more fluid chambers 212 and collapsing the one or more inflatable elements 214.

Figure 7:
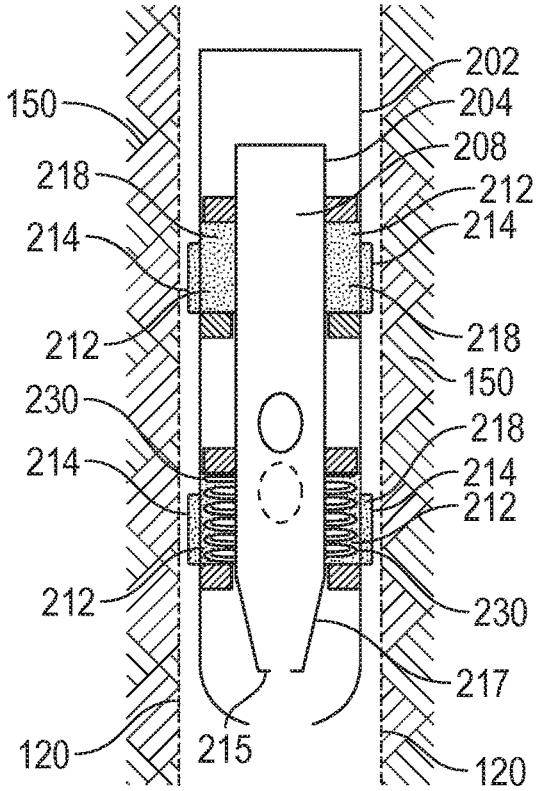
FIG. 7 is a diagrammatic view of a wellbore isolation assembly in a first position, according to the present disclosure.

FIG. 7 a diagrammatic view of a wellbore isolation system further transitioned back to a first position from a second position. The wellbore isolation system 200 can draw the working fluid 218 into the one or more fluid chambers 212 formed in the annulus 210 between the floating inner mandrel 204 and the outer housing 202.

The biasing element 230 can be a coil spring operable to bias the wellbore isolation system 200 to the first position.

The biasing element 230 can be compressed by the actuation force 220 (shown in FIG. 3), thus allowing the wellbore isolation system 200 to transition to the first position, however, the biasing element 230 can assist in returning the floating inner mandrel 204 uphole relative to the outer housing 202.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

Statement Bank:

Statement 1: A wellbore isolation assembly, comprising: an outer housing having an inner bore formed therethrough, the outer housing having a treatment port formed therein providing fluidic communication between the inner bore and the exterior; a floating inner mandrel disposed within the inner bore of the outer housing, the floating inner mandrel having an inner bore formed therethrough, the floating inner mandrel having a fluid port formed therein providing fluidic communication between the inner bore and an annulus formed between the floating inner mandrel and the outer housing; one or more fluid chambers disposed in the annulus, the one or more fluid chambers having a working fluid operably disposed therein; one or more inflatable elements operable to receive the working fluid therein; a plunger disposed in the annulus and coupled with the floating inner mandrel, wherein the floating inner mandrel is operable to transition between a first position and a second position, the treatment port and the fluid port substantially aligned in the second position, wherein the plunger urges the working fluid from the one or more fluid chambers to the one or more inflatable elements.

Statement 2: The wellbore isolation assembly of Statement 1, wherein the one or more inflatable elements fills with working fluid in the second position, and is substantially devoid of working fluid in the first position.

Statement 3: The wellbore isolation assembly of Statements 1 or 2, wherein an actuation force transitions the floating inner mandrel from the first position to the second position.

Statement 4: The wellbore isolation assembly of any one of Statements 1-3, the actuation force is a fluid flow through the inner bore of the floating inner mandrel.

Statement 5: The wellbore isolation assembly of any one of Statements 1-4, wherein the floating inner mandrel has an aperture formed at one distal end.

Statement 6: The wellbore isolation assembly of any one of Statements 1-5, wherein the aperture is operable to receive a ball and/or dart, thereby restricting fluid flow through the inner bore of the floating inner mandrel.

Statement 7: The wellbore isolation assembly of any one of Statements 1-6, further comprising a biasing element urging the floating inner mandrel to the first position.

Statement 8: A wellbore isolation system comprising: a downhole tool string having a wellbore isolation system operably disposed within a wellbore, the wellbore isolation system comprising: an outer housing having an inner bore formed therethrough, the outer housing having a treatment port formed therein providing fluidic communication between the inner bore and the exterior; a floating inner mandrel disposed within the inner bore of the outer housing, the floating inner mandrel having an inner bore formed therethrough, the floating inner mandrel having a fluid port formed therein providing fluidic communication between the inner bore and an annulus formed between the floating inner mandrel and the outer housing; one or more fluid chambers disposed in the annulus, the one or more fluid chambers having a working fluid operably disposed therein; one or more inflatable elements operable to receive the working fluid therein; a plunger disposed in the annulus and coupled with the floating inner mandrel, wherein the floating inner mandrel is operable to transition between a first position and a second position, the treatment port and the fluid port substantially aligned in the second position, wherein the plunger urges the working fluid from the one or more fluid chambers to the one or more inflatable elements.

Statement 9: The wellbore isolation assembly of Statement 8, wherein the one or more inflatable elements fills with working fluid in the second position, and is substantially devoid of working fluid in the first position.

Statement 10: The wellbore isolation assembly of one of Statements 8 or Statement 9, wherein an actuation force transitions the floating inner mandrel from the first position to the second position.

Statement 11: The wellbore isolation assembly of any one of Statements 8-10, the actuation force is a fluid flow through the inner bore of the floating inner mandrel.

Statement 12: The wellbore isolation assembly of Statements 8-11, wherein the floating inner mandrel has an aperture formed at one distal end.

Statement 13: The wellbore isolation assembly of Statements 8-11, wherein the aperture is operable to receive a ball and/or dart, thereby restricting fluid flow through the inner bore of the floating inner mandrel.

Statement 14: The wellbore isolation assembly of Statements 8-13, further comprising a biasing element urging the floating inner mandrel to the first position.

Statement 15. A wellbore isolation method comprising: disposing a downhole string within a wellbore formed in a subterranean formation, the downhole tool string having a wellbore isolation assembly therein, the wellbore isolation assembly having an outer housing and a floating inner mandrel; actuating the wellbore isolation assembly to transition the floating inner mandrel from a first position to a second position; transferring a working fluid from one or more fluid chambers disposed in an annulus formed between the outer housing and the floating inner mandrel to one or more inflatable elements; inflating the one or more inflatable elements by receiving the working fluid therein until substantial engagement between the one or more inflatable elements and the wellbore formed in the subterranean formation.

What is claimed is:

1. A well bore isolation assembly, comprising:

an outer housing having an inner bore formed therethrough, the outer housing having a treatment port formed therein providing fluidic communication between the inner bore and an exterior;

a floating inner mandrel disposed within the inner bore of the outer housing, the floating inner mandrel having an inner bore formed therethrough, the floating inner mandrel having a fluid port formed therein providing fluidic communication between the inner bore and an annulus formed between the floating inner mandrel and the outer housing;

one or more fluid chambers disposed in the annulus, the one or more fluid chambers having a working fluid operably disposed therein;

one or more inflatable elements operable to receive the working fluid therein and are configured to be retracted and repositioned within the well bore;

a plunger disposed in the annulus and coupled with the floating inner mandrel, wherein the floating inner mandrel is operable to transition between a first position and a second position, the treatment port and the fluid port substantially aligned in the second position, wherein the plunger urges the working fluid from the one or more fluid chambers to the one or more inflatable elements.

2. The well bore isolation assembly of claim 1, wherein the one or more inflatable elements fills with working fluid in the second position, and is substantially devoid of working fluid in the first position.

3. The well bore isolation assembly of claim 1, wherein an actuation force transitions the floating inner mandrel from the first position to the second position.

4. The well bore isolation assembly of claim 3, wherein the actuation force is a fluid flow through the inner bore of the floating inner mandrel.

5. The well bore isolation assembly of claim 1, wherein the floating inner mandrel has an aperture formed at one distal end.

6. The well bore isolation assembly of claim 5, wherein the aperture is operable to receive a ball and/or dart, thereby restricting fluid flow through the inner bore of the floating inner mandrel.

7. The well bore isolation assembly of claim 1, further comprising a biasing element urging the floating inner mandrel to the first position.

8. A well bore isolation system comprising:

a downhole tool string having a wellbore isolation system operably disposed within a well bore, the well bore isolation system comprising:

an outer housing having an inner bore formed therethrough, the outer housing having a treatment port formed therein providing fluidic communication between the inner bore and an exterior;

a floating inner mandrel disposed within the inner bore of the outer housing, the floating inner mandrel having an inner bore formed therethrough, the floating inner mandrel having a fluid port formed therein providing fluidic communication between the inner bore and an annulus formed between the floating inner mandrel and the outer housing;

one or more fluid chambers disposed in the annulus, the one or more fluid chambers having a working fluid operably disposed therein;

one or more inflatable elements operable to receive the working fluid therein and are configured to be retracted and repositioned within the well bore;

a plunger disposed in the annulus and coupled with the floating inner mandrel, wherein the floating inner mandrel is operable to transition between a first position and a second position, the treatment port and the fluid port substantially aligned in the second position, wherein the plunger urges the working fluid from the one or more fluid chambers to the one or more inflatable elements.

9. The well bore isolation system of claim 8, wherein the one or more inflatable elements fills with working fluid in the second position, and is substantially devoid of working fluid in the first position.

10. The well_bore isolation system of claim 8, wherein an actuation force transitions the floating inner mandrel from the first position to the second position.

11. The well_bore isolation system of claim 10, wherein the actuation force is a fluid flow through the inner bore of the floating inner mandrel.

12. The well_bore isolation system of claim 8, wherein the floating inner mandrel has an aperture formed at one distal end.

13. The well_bore isolation system of claim 12, wherein the aperture is operable to receive a ball and/or dart, thereby restricting fluid flow through the inner bore of the floating inner mandrel.

14. The well_bore isolation system of claim 8, further comprising a biasing element urging the floating inner mandrel to the first position.

15. A well bore isolation method comprising:

disposing a downhole string within a wellbore formed in a subterranean formation, the downhole string having a wellbore isolation assembly therein, the well bore isolation assembly having an outer housing and a floating inner mandrel;

actuating the wellbore isolation assembly to transition the floating inner mandrel from a first position to a second position;

transferring a working fluid from one or more fluid chambers disposed in an annulus formed between the outer housing and the floating inner mandrel to one or more inflatable elements;

inflating the one or more inflatable elements by receiving the working fluid therein until substantial engagement between the one or more inflatable elements and the wellbore formed in the subterranean formation, wherein the one or more inflatable elements are configured to be retracted and repositioned within the well bore, wherein a plunger arranged in the annulus and coupled with the floating inner mandrel urges the working fluid from the one or more fluid chambers to the one or more inflatable elements.

16. The well bore isolation method of claim 15, wherein the one or more inflatable elements fills with working fluid in the second position, and is substantially devoid of working fluid in the first position.

17. The well bore isolation method of claim 15, wherein an actuation force transitions the floating inner mandrel from the first position to the second position.

18. The well bore isolation method of claim 17, wherein the actuation force is a fluid flow through the inner bore of the floating inner mandrel.

19. The well bore isolation method of claim 15, wherein the floating inner mandrel has an aperture formed at one distal end.

20. The well bore isolation method of claim 19 wherein the aperture is operable to receive a ball and/or dart, thereby restricting fluid flow through the inner bore of the floating inner mandrel.

* * * * *